US008848961B2

(12) United States Patent
Huang et al.

(10) Patent No.: US 8,848,961 B2
(45) Date of Patent: Sep. 30, 2014

(54) SPEAKER BOX WITH U-SHAPED BENDING CHANNELS

(71) Applicants: Xing-Zhi Huang, Shenzhen (CN); Xu-Dong Yan, Shenzhen (CN)

(72) Inventors: Xing-Zhi Huang, Shenzhen (CN); Xu-Dong Yan, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 14/020,966

(22) Filed: Sep. 9, 2013

(65) Prior Publication Data

US 2014/0072162 A1 Mar. 13, 2014

(30) Foreign Application Priority Data

Sep. 12, 2012 (CN) ..... 2012 2 0464074 U

(51) Int. Cl.
*H04R 1/02* (2006.01)
*H04R 1/20* (2006.01)
*H04R 1/28* (2006.01)

(52) U.S. Cl.
CPC ..... *H04R 1/2807* (2013.01)
USPC ..... 381/353; 381/351

(58) Field of Classification Search
CPC ..... H04R 1/20; H04R 1/22; H04R 1/28; H04R 1/2803; H04R 1/2807; H04R 1/2811; H04R 1/2815; H04R 1/2819; H04R 1/2823; H04R 1/2853; H04R 1/2857
USPC ..... 381/338, 345, 349–353, 87, 332–336; 181/196, 198–199
See application file for complete search history.

(56) References Cited

U.S. PATENT DOCUMENTS

2005/0117766 A1* 6/2005 Ito et al. ..... 381/333

* cited by examiner

*Primary Examiner* — Ahmad Matar
*Assistant Examiner* — Katherine Faley
(74) *Attorney, Agent, or Firm* — Na Xu; IPro, Inc.

(57) ABSTRACT

One embodiment of the invention discloses a speaker box having a housing and a speaker accommodated in the housing. The speaker includes a sound radiation surface for generating sound. The housing includes a first and second output ports disposed at one side of the housing for transmitting the sound to outside of the speaker box. The housing includes a plurality of ribs disposed therein and forming a bending channel. The first and second output ports are disposed at two ends of the bending channel. The bending channel is divided into a front channel and a back channel by the speaker. The speaker box is capable of obtaining a better low frequency sound reproduction quality.

15 Claims, 3 Drawing Sheets

SPEAKER BOX WITH U-SHAPED BENDING CHANNELS

FIELD OF THE INVENTION

One embodiment of the invention is related to a speaker box, and more particularly to a speaker box having an excellent reproduction in lower-frequency.

DESCRIPTION OF RELATED ART

A speaker box is an open chamber mounted in an audio equipment and helps transfer sound to surrounding air. A reproduction of the speaker box has a significant impact on a tone quality of the audio equipment. The speaker box typically enhances a lower-frequency reproduction of the equipment.

In a typical speaker box, a sound radiation surface is provided for generating sound. Generally, the sound radiation surface is a membrane or a diaphragm which is activated by an electrified voice coil. While activated, the sound radiation surface vibrates and produces audible sounds. And a speaker with a large vibration amplitude could not admit a high power which is bad for enhancing the low-frequency reproduction of the speaker box.

A related speaker box includes a housing with a chamber and a speaker disposed within the chamber. However, the chamber usually has a small matching impedance so as to the speaker has a large vibration amplitude and the speaker box has a weak low-frequency reproduction.

Therefore, an improved speaker box is provided in the embodiment of the present disclosure to solve the problem mentioned above.

Figure 1:
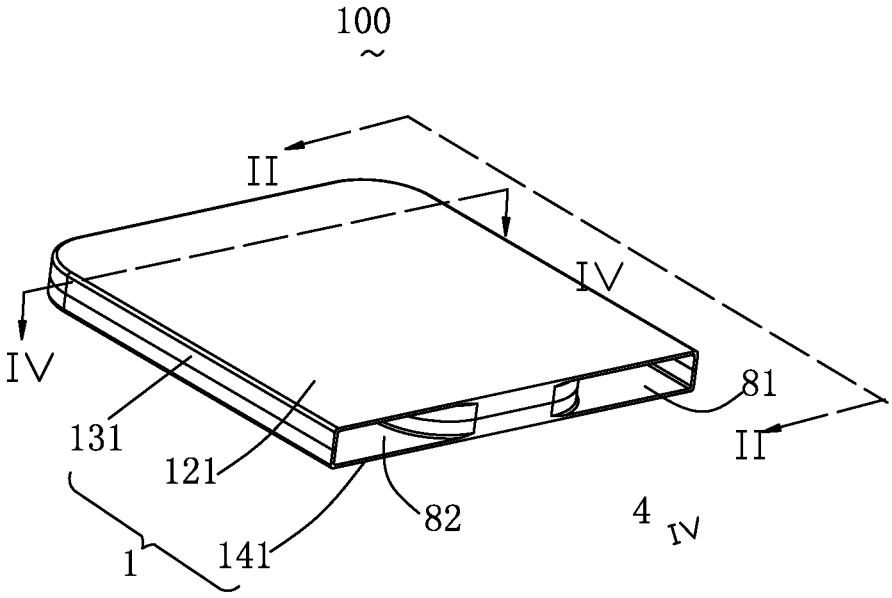
FIG. 1 is an illustrative isometric view of a speaker box related to the present invention.

Many aspects of the embodiments can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Reference will now be made to describe exemplary embodiments of the present invention in detail. In this section we shall explain several exemplary embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Referring to FIG. 1, a speaker box 100 in accordance with the present disclosure includes a housing 1 having a receiving space, a first output port 81 and a second output port 82 disposed at one side of the housing 1 and communicating the receiving space with outside of the housing 1. The housing 1 includes a top wall 121, a bottom wall 141 parallel to the top wall and a plurality of sidewalls 131 connecting the top wall 121 and the bottom wall 141. The top wall 121, the bottom wall 141 and the sidewalls 131 together form the receiving space.

Figure 2:
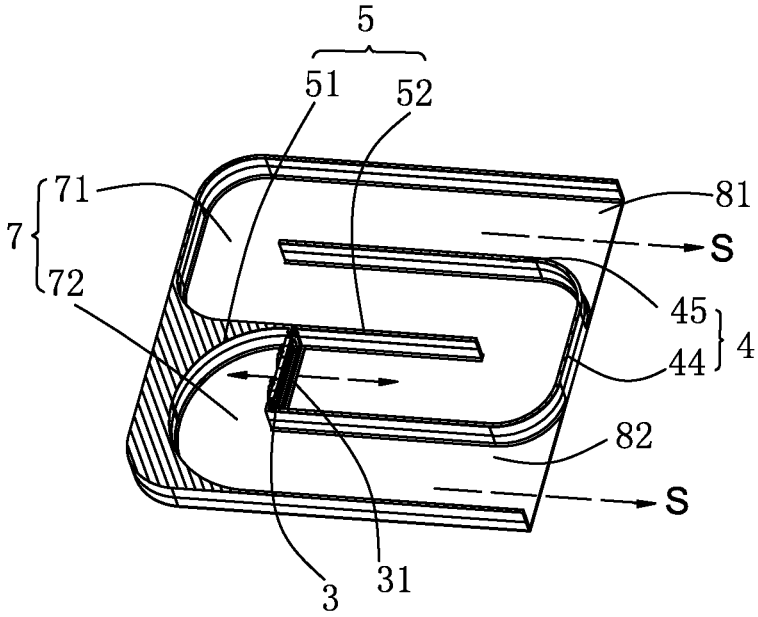
FIG. 2 is a cross section view of the speaker box taken along line II-II in FIG. 1.

Referring to FIG. 2, the speaker box 100 includes a plurality of ribs disposed in the housing 1 and dividing the receiving space into a bending channel 7 extending along a devious path parallel to the top wall 1. The speaker box 100 further includes a speaker 3 disposed within the bending channel 7.

The plurality of ribs includes a first guiding member 4 and a second guiding member 5 disposed between the top wall 121 and the bottom wall 141. The first guiding member 4 has a U-shaped configuration, includes a base portion 44 and a pair of arm portions 45 extending from two ends of the base portion 44. The base portion 44 is disposed between the first and second output ports 81, 82. The arm portion 45 extends away from the first and second output ports 81, 82 and is spaced from the sidewalls 131. The second guiding member 5 includes a first end 51 connecting the sidewall 131, a second end 52 extending from the first end 51 towards the base portion 44 and is spaced from the base portion 44. The second end 52 has a strip configuration and is disposed between the two arm portions 45 of the first guiding member 4. This invention is not restricted to the amount or the shape of each of ribs, as long as the ribs corporately divide the receiving space into the bending channel.

Figure 3:
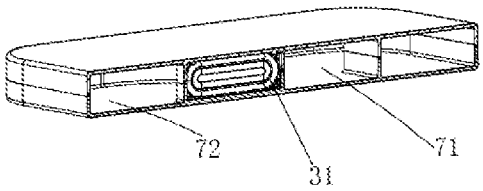
FIG. 3 is a cross section view of the speaker box taken along line IV-IV in FIG. 1.

Referring to FIGS. 2-3, the bending channel 7 has a regular configuration and has an equal cross section area almost everywhere. The first output port 81 and the second output port 82 are disposed at two ends of the bending channel 7 and communicating the bending channel 7 with outside of the housing 1. The speaker 3 includes a sound radiation surface 31 for generating sound. The sound radiation surface 31 is a membrane or a diaphragm which is activated by a pair of electrified voice coils, and is perpendicular to the top wall 121 and the bottom wall 141. The sound radiation surface 31 has an area roughly same with or smaller than the cross section area of the bending channel 7. Therefore, the speaker 3 has a vibration area that is the same or smaller than the cross section area of the bending channel 7. The speaker 3 is disposed between one of the arm portions 42 and the second guiding member 5. The sound radiation surface 31 faces towards the base portion 44 of the first guiding member 4. In alternative embodiment, the amount of the voice coil may be one or two more.

Referring to FIGS. 2-5, the housing 1 further includes a holding member 2 for holding the speaker 3 in the bending channel 7. The holding member 2 includes a plate 21 disposed at the top wall 121, and a card slot 22 disposed at the bottom wall 141 for the speaker 3 inserting into. The holding member 2 and the speaker 3 corporately divide the bending channel 7 into a front channel 71 and a back channel 72. The front channel 71 is disposed in front of the sound radiation surface 31 and communicating with the first output port 11. The back channel 72 is disposed in back of the sound radiation surface 31 and communicating with the second output port 13. The front channel 71 is isolated from the back channel 72 by the speaker 3 and the holding member 2. The configuration of the holding member is used to support or fix the speaker, so, in fact, the holding member may be configured to be any shape. In alternative embodiment, the holding member 2 could be omitted. And the front channel and the second channel are isolated from each other by the speaker.

Figure 5:
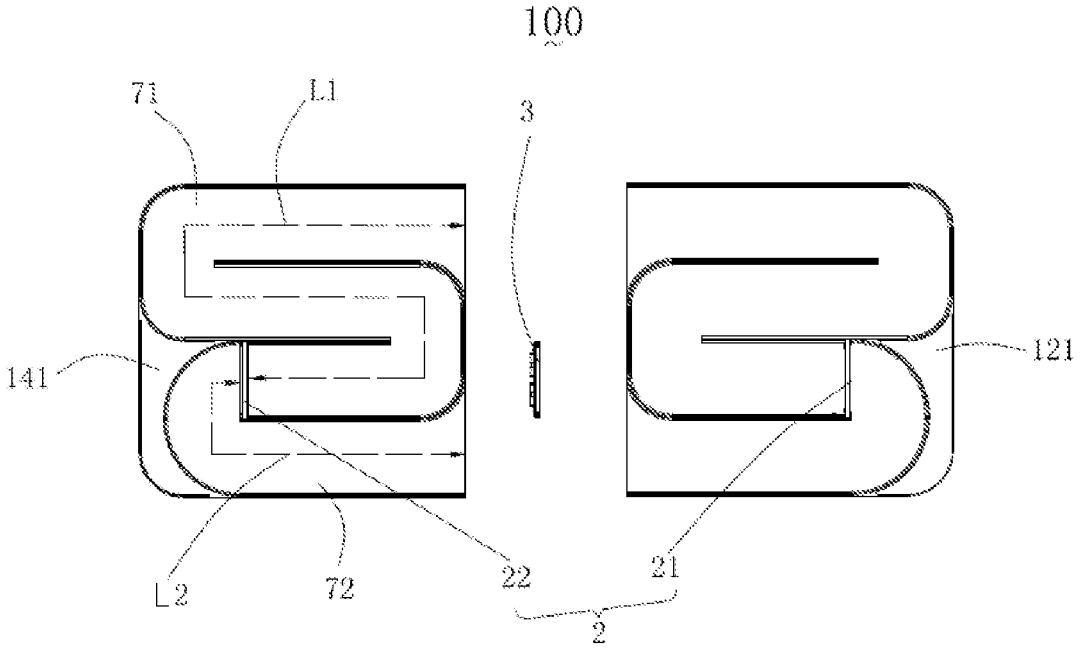
FIG. 5 is a top view of the speaker box in FIG. 4, with the upper cover turning 180°. The left image shows a top view of the lower cover, and the right images shows a top view of the upper cover.

Referring to FIG. 5, the speaker 3 defines a response frequency f0. The front channel 71 has a full length L1 substantially equal to one quarter of a wavelength of the response frequency f0. The back channel 72 has a full length L2 substantially equal to one third of the full length L1.

Referring back to FIG. 2, the front channel 71 transmits sounds from a front face of the sound radiation surface 31 to the first output port 81. The back channel 72 transmits sounds from a back face of the sound radiation surface 31 to the second output port 82. Both sounds getting out of the first output port 81 and the second output port 82 to outside of the housing travel along a same direction S. And a superposition of sounds is obtained.

The speaker box 100 has a enhanced matching impedance because of the bending channel, which makes the vibration amplitude of the sound radiation surface reduce and admit a higher power. Therefore, the speaker box 100 is capable of obtaining a higher sound reproduction in low-frequency.

Figure 4:
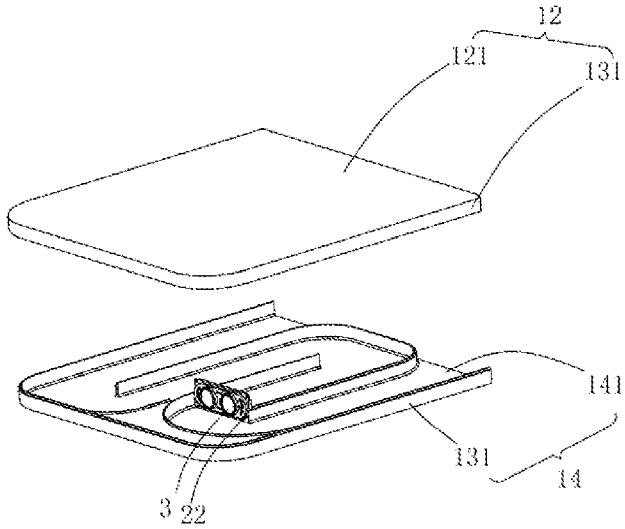
FIG. 4 is a partially assembled view of the speaker box in FIG. 1, with an upper cover separated.

Referring to FIGS. 4-5, in this embodiment, the housing 1 includes an upper cover 12 and a lower cover 14 corporately forming the receiving space. The upper cover 12 includes the top wall 121 and one half of the sidewalls 131. The lower cover 14 includes the bottom wall 141 and the other half of the sidewalls 131. Each of ribs includes an upper half disposed at the upper cover 12 and a lower half disposed at the lower cover 14 and engaged with the upper half. The speaker 3 is located between the upper cover 12 and the lower cover 14. In alternative embodiments, the whole of ribs may be disposed at one of the upper cover 12 and the lower cover 14. The upper cover 12 and the lower cover 14 could be integrated.

The embodiments described above indeed disclose one common configuration of a speaker box, which could be described from another aspect, as follows.

A speaker box includes a housing and a speaker accommodated in the housing. The speaker includes a sound radiation surface for generating sound. The housing includes a top wall, a bottom wall, and a plurality of sidewalls connecting the top wall to the bottom wall, and a first and second output ports disposed at one side of the housing for transmitting the sound to outside of the speaker box. The housing includes a plurality of ribs disposed therein and forming a bending channel. The first and second output ports are disposed at two ends of the bending channel and communicating the bending channel with outside of the speaker box. The speaker is disposed in the bending channel with the sound radiation surface vertical to the top wall and disposed at a cross section plane of the bending channel so that sound transmitting along the bending channel. The bending channel is divided into a front channel and a back channel by the speaker. The front channel transmits sounds from a front face of the speaker to the first output port. The back channel transmits sounds from a back face of the speaker to the second output port. The back channel has a full length L2 equal to one third of a full length L1 of the front channel. The speaker defines a resonance frequency f0. The full length L1 of the front channel is equal to one quarter of a wavelength of the resonance frequency f0. A holding member is provided to fix the speaker in the housing. The radiation surface of the speaker has an area same with or smaller than an area of the cross section of the bending channel so that a vibration area of the speaker is same with or smaller than the area of the cross section of the bending channel. Sounds coming from the first output port and the second output port travel along a same direction S. A superposition of sounds from the first and second output ports is obtained.

While the present disclosure has been described with reference to the specific embodiments, the description of the disclosure is illustrative and is not to be construed as limiting the disclosure. Various of modifications to the present disclosure can be made to the exemplary embodiments by those skilled in the art without departing from the true spirit and scope of the disclosure as defined by the appended claims.

What is claimed is:

1. A speaker box, comprising a housing including a top wall, a bottom wall and a plurality of sidewalls together forming a receiving space, a first output port, and a second output port separately disposed at one side of the housing;

a plurality of ribs disposed within the receiving space and corporately forming a bending channel with the housing;

a speaker including a sound radiation surface, accommodated in the bending channel and dividing the bending channel into a front channel and a back channel, the front channel transmitting sounds from a front face of the sound radiation surface to the first output port, the back channel transmitting sounds from a back face of the sound radiation surface to the second output port; wherein sounds coming from the first output port and the second output port travel along a same direction; and the back channel defines a full length substantially equal to one third of the full length of the front channel.

2. The speaker box as described in claim 1, wherein the speaker defines a resonance frequency f0, the full length of the front channel is substantially equal to one quarter of a wavelength of a sound wave at the resonance frequency f0.

3. The speaker box as described in claim 1, wherein the bending channel has a constant cross section area along a length of the bending channel.

4. The speaker box as described in claim 3, wherein the sound radiation surface of the speaker defines an area substantially equal to or smaller than the cross section area of the bending channel where the speaker is located.

5. The speaker box as described in claim 1, wherein the plurality of ribs includes a U-shaped first guiding member and a second guiding member.

6. The speaker box as described in claim 5, wherein the first guiding member includes a base portion disposed between the first output port and the second output port, two arm portions extending along a direction away from the first and second output ports and spaced from the sidewalls of the housing.

7. The speaker box as described in claim 6, wherein the second guiding member includes a first end connecting with a sidewall of the plurality of sidewalls of the housing and a second end extending from the first end towards the base portion of the first guiding member and spaced from the base portion, the second end disposed between the two arm portions of the first guiding member.

8. The speaker box as described in claim 7, wherein the speaker is disposed between one of the two arm portions and the second end.

9. The speaker box as described in claim 7 further including a holding member disposed between one of the two arm portions and the second end for holding the speaker.

10. The speaker box as described in claim 9, wherein the holding member includes a plate disposed at the top wall and a card slot disposed at the bottom wall for insertion of the speaker.

11. The speaker box as described in claim 1, wherein the housing includes an upper cover and a lower cover engaged with the upper cover.

12. The speaker box as described in claim 11, wherein the plurality of ribs includes an upper half disposed at the upper cover, and a lower half engaged with the upper half disposed at the lower cover.

13. A speaker box, comprising a housing including a top wall and a bottom wall parallel to the top wall, and a plurality of sidewalls connecting the top wall and the bottom wall;

a bending channel disposed within the housing and extending along a devious path parallel to the top wall;

a first output port and a second output port disposed at two ends of the bending channel and disposed at one side of the housing;

a speaker disposed within the bending channel and dividing the bending channel into a front channel and a back channel, the speaker including a sound radiation surface perpendicular to the top wall and facing towards the front channel;

a full length of the back channel being substantially equal to one third of a full length of the front channel.

14. The speaker box as described in claim 13, wherein the first output port communicates with the front channel and the second output port communicates with the back channel.

15. The speaker box as described in claim 14, wherein sounds coming from the first output port and sounds coming from the second output travel along a same direction.

* * * * *